US005549531A

United States Patent [19]

Campbell

[11] Patent Number: 5,549,531

[45] Date of Patent: Aug. 27, 1996

[54] WEIGHTLIFTING MACHINE WITH SAFETY DEVICE

[76] Inventor: Matthew W. Campbell, R.R. 4 Box 148, Portland, Ind. 47371

[21] Appl. No.: 395,796

[22] Filed: Feb. 28, 1995

[51] Int. Cl.[6] ..... A63B 13/00

[52] U.S. Cl. ..... 482/106; 482/104; 482/142

[58] Field of Search ..... 482/104, 106, 482/108, 142, 908, 93, 94, 133–135

[56] References Cited

U.S. PATENT DOCUMENTS

| | | | |
|---|---|---|---|
| 4,822,034 | 4/1989 | Sheilds | 482/106 |
| 4,875,676 | 10/1989 | Santoro et al. | 482/106 |
| 5,151,072 | 9/1992 | Cone et al. | 482/104 |
| 5,190,510 | 3/1993 | Goodger | 482/104 |
| 5,273,506 | 12/1993 | Dawson, Jr. | 482/104 |
| 5,310,394 | 5/1994 | Kallios | 482/104 |
| 5,314,394 | 5/1994 | Ronan | 482/104 |

*Primary Examiner*—Stephen R. Crow
*Assistant Examiner*—Jerome Donnelly

[57] ABSTRACT

A weightlifting machine with safety device comprised of a hollow frame portion. Included in the device is a pulley system comprised of a plurality of pulley cages and a cable securable within the hollow frame portion. The cable has a first end for engaging a weightbar. A safety mechanism is secured to the hollow frame portion. The safety mechanism has a foot pedal secured on opposing sides thereof. The foot pedals are pivotally secured to a securement bar extending within the safety mechanism and slidably coupled therein. The securement bar is secured to a second end of the cable of the pulley system. The safety mechanism has a plurality of locking notches therein to engage the securement bar for protection of a weightlifter on a weightbench.

5 Claims, 4 Drawing Sheets

WEIGHTLIFTING MACHINE WITH SAFETY DEVICE

BACKGROUND OF THE INVENTION

1. Field of the Invention

The present invention relates to a weightlifting machine with safety device and more particularly pertains to protecting a user from injury when not being able to lift a weightbar with a weightlifting machine with safety device.

2. Description of the Prior Art

The use of weight-training devices is known in the prior art. More specifically, weight-training devices heretofore devised and utilized for the purpose of utilizing weights for fitness training are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,334,113 to Roepke discloses a multi-position grip system for barbells.

U.S. Pat. No. 5,281,193 to Colbo, Jr. discloses a bench-press weight workout station with safety features.

U.S. Pat. No. 5,190,510 to Goodger discloses a bench press apparatus with a built in hoist and safety switch to lift the accompanying barbell weights up and away from the fitness user.

U.S. Pat. No. 4,757,998 to Landin discloses a safety device for a weight-training bench.

While these devices fulfill their respective, particular objective and requirements, the aforementioned patents do not describe a weightlifting machine with safety device for protecting a user from injury when not being able to lift a weightbar.

In this respect, the weightlifting machine with safety device according to the present invention substantially departs from the conventional concepts and designs of the prior art, and in doing so provides an apparatus primarily developed for the purpose of protecting a user from injury when not being able to lift a weightbar.

Therefore, it can be appreciated that there exists a continuing need for new and improved weightlifting machine with safety device which can be used for protecting a user from injury when not being able to lift a weightbar. In this regard, the present invention substantially fulfills this need.

SUMMARY OF THE INVENTION

In the view of the foregoing disadvantages inherent in the known types of weight-training devices now present: in the prior art, the present invention provides an improved weightlifting machine with safety device. As such, the general purpose of the present invention, which will be described subsequently in greater detail, is to provide a new and improved weightlifting machine with safety device and method which has all the advantages of the prior art and none of the disadvantages.

To attain this, the present invention essentially comprises a hollow frame portion comprised of a first horizontal portion, a second horizontal portion, a vertical portion, and a diagonal portion. The first horizontal portion has an upwardly open first end, a second end, and an intermediate extent therebetween. The intermediate extent has an opening formed in a top surface thereof inwardly of the second end thereof. The second horizontal portion has a downwardly open first end and an open second end. The vertical portion has an open first end and an open second end. The diagonal portion has an open first end and an open second end. The open first end of the vertical portion is secured to the upwardly open first end of the first horizontal portion. The open second end of the vertical portion is secured to the downwardly open first end of the second horizontal portion. The open first end of the diagonal portion is secured to the opening in the intermediate extent of the first horizontal portion. The device contains a pulley system comprised of a plurality of pulley cages. The plurality of pulley cages are securable within the hollow frame portion. The pulley system has a cable. The cable has a first end, a second end, and an intermediate extent therebetween. The first end extends outwardly of the downwardly open second end of the second horizontal portion. The first end has a securement means adapted to be secured to a weightbar. The second end of the cable extends outwardly of the open second end of the diagonal portion. The intermediate extent extends through the plurality of pulley cages within the hollow frame portion. A safety mechanism is secured to the open second end of the diagonal portion. The safety mechanism has a foot pedal secured on opposing sides thereof. The foot pedals are pivotally secured to a securement bar extending within the safety mechanism and slidably coupled therein. The securement bar is secured to the second end of the cable of the pulley system. The safety mechanism has a plurality of locking notches therein to engage the securement bar. The device contains a weightlifting bench having forward and rearward ends for supporting a weightlifter thereon in a generally supine position along its longitudinal length and has upright weight supports for supporting weights placed thereon located adjacent to the forward ends. The rearward ends are adjacent to the foot pedals of the safety mechanism for engagement thereof by the weightlifter.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved weightlifting machine with safety device which has all the advantages of the prior art weight-training devices and none of the disadvantages.

It is another object of the present invention to provide a new and improved weightlifting machine with safety device which may be easily and efficiently manufactured and marketed.

It is a further object of the present invention to provide a new and improved weightlifting machine with safety device which is of durable and reliable construction.

An even further object of the present invention is to provide a new and improved weightlifting machine with safety device which is susceptible of a low cost of manufacture with regard to both materials and labor, and which accordingly is then susceptible of low prices of sale to the consuming public, thereby making such a weightlifting machine with safety device economically available to the buying public.

Still yet another object of the present invention is to provide a new and improved weightlifting machine with safety device which provides in the apparatuses and methods of the prior art some of the advantages thereof, while simultaneously overcoming some of the disadvantages normally associated therewith.

Even still another object of the present invention is to provide a new and improved weightlifting machine with safety device for protecting a user from injury when not being able to lift a weightbar.

Lastly, it is an object of the present invention to provide a new and improved weightlifting machine with safety device comprised of a hollow frame portion. Included in the device is a pulley system comprised of a plurality of pulley cages and a cable securable within the hollow frame portion. The cable has a first end for engaging a weightbar. A safety mechanism is secured to the hollow frame portion. The safety mechanism has a foot pedal secured on opposing sides thereof. The foot pedals are pivotally secured to a securement bar extending within the safety mechanism and slidably coupled therein. The securement bar is secured to a second end of the cable of the pulley system. The safety mechanism has a plurality of locking notches therein to engage the securement bar for protection of a weightlifter on a weightbench.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
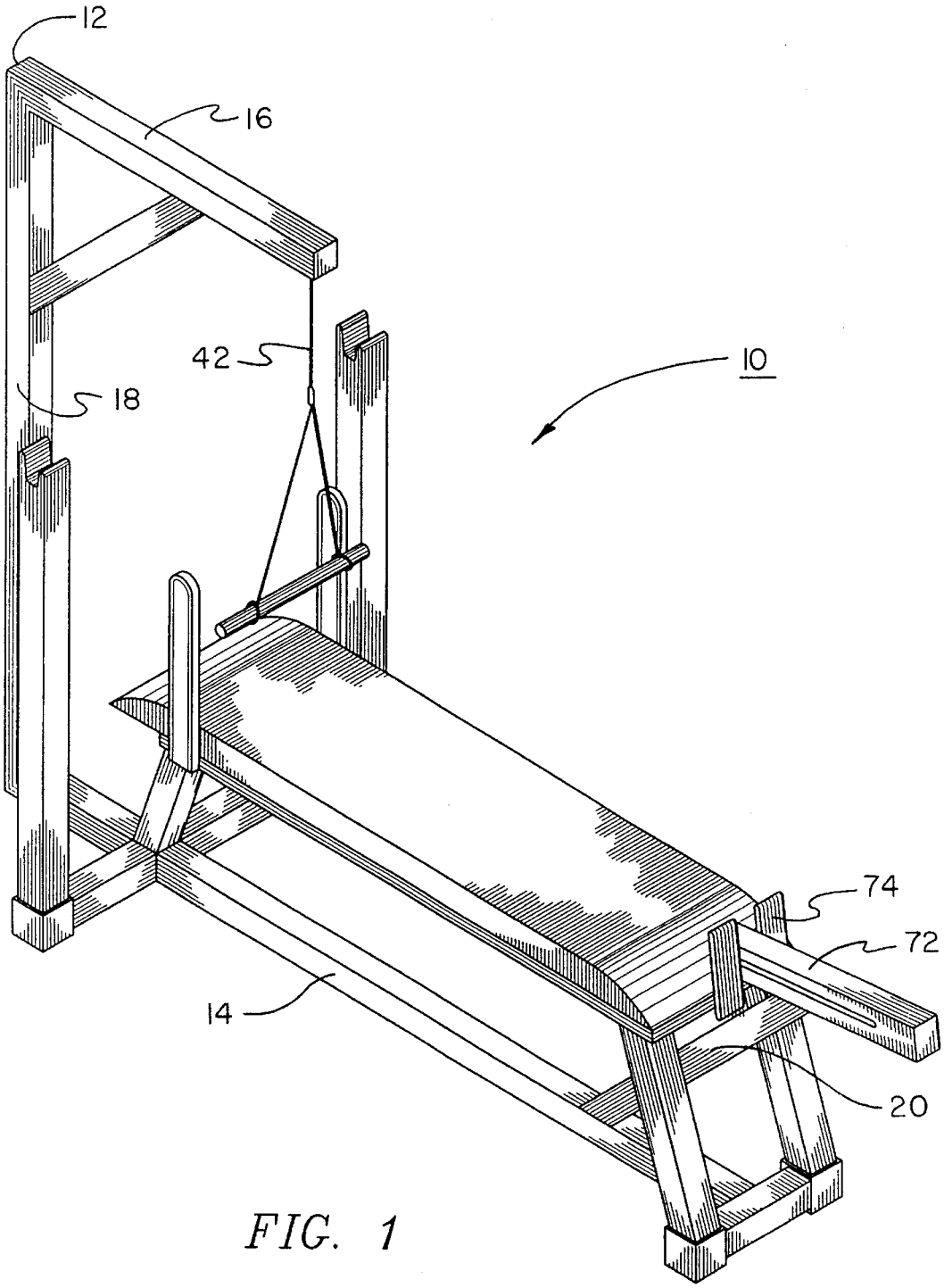
FIG. 1 is a perspective view of the preferred embodiment of the weightlifting machine with safety device constructed in accordance with the principles of the present invention.
Figure 2:
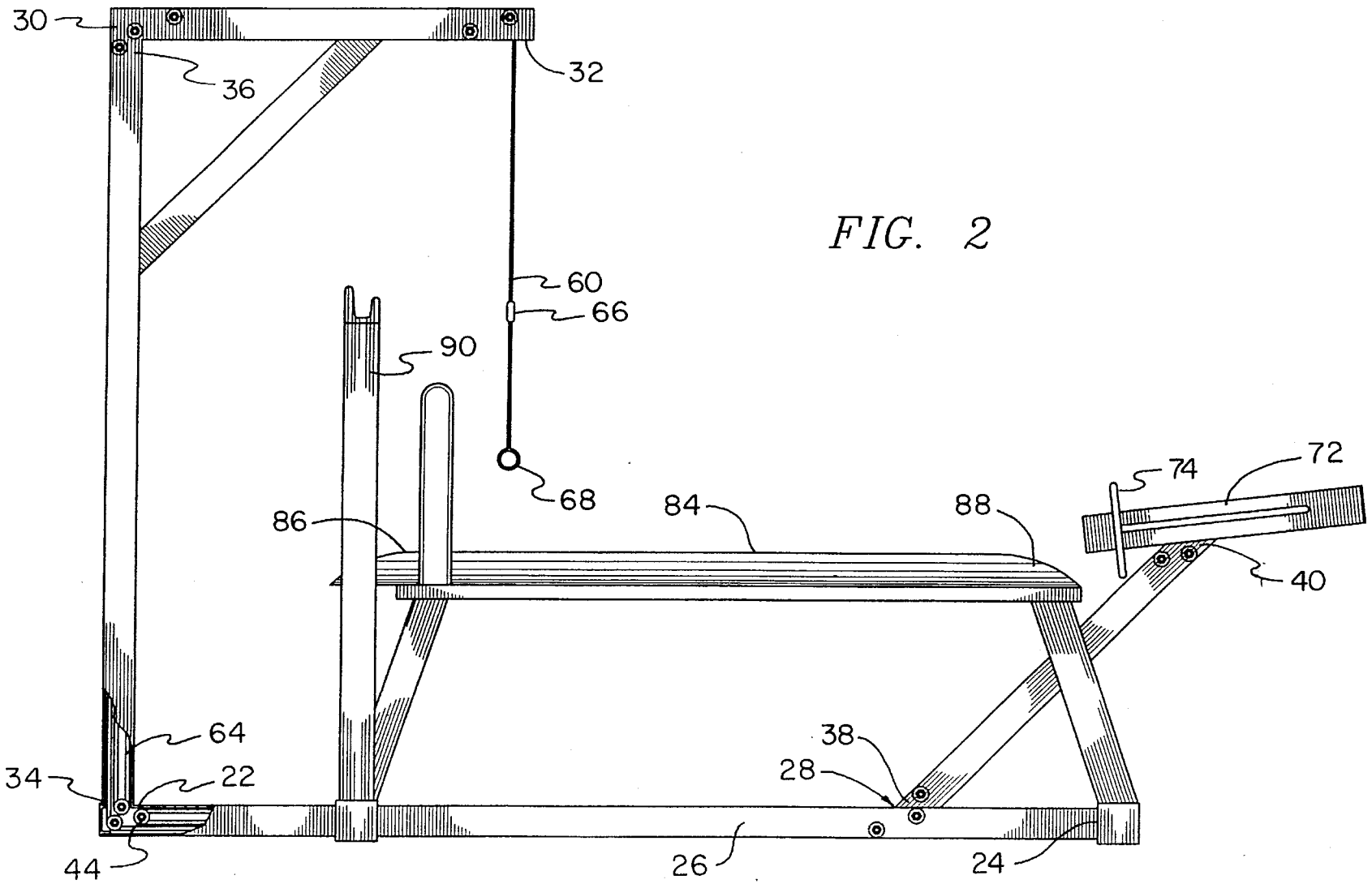
FIG. 2 is a side elevation view of the present invention.
Figure 3:
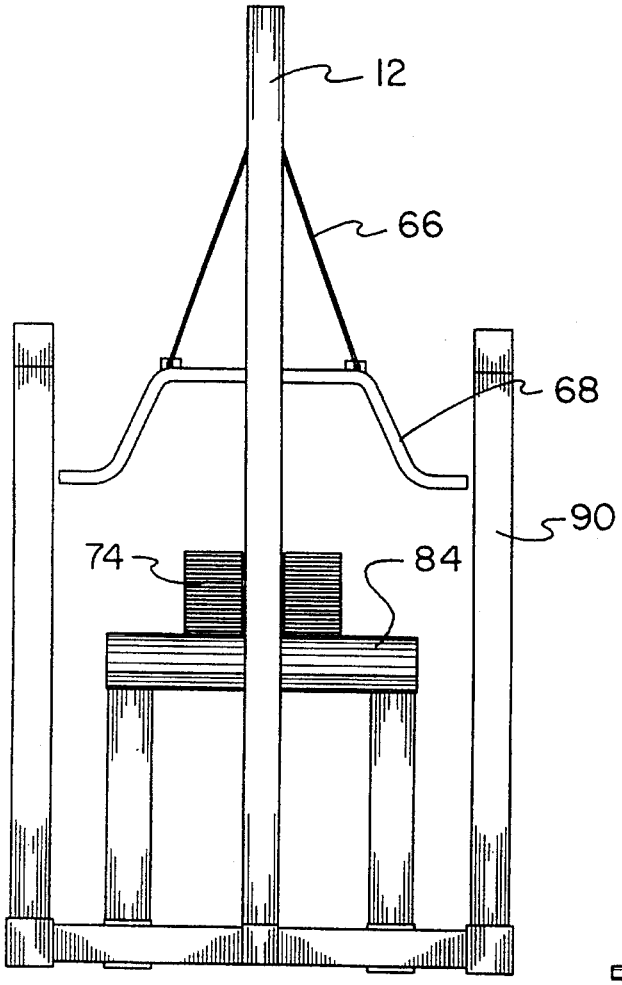
FIG. 3 is a rear elevation view of the present invention.
Figure 4:
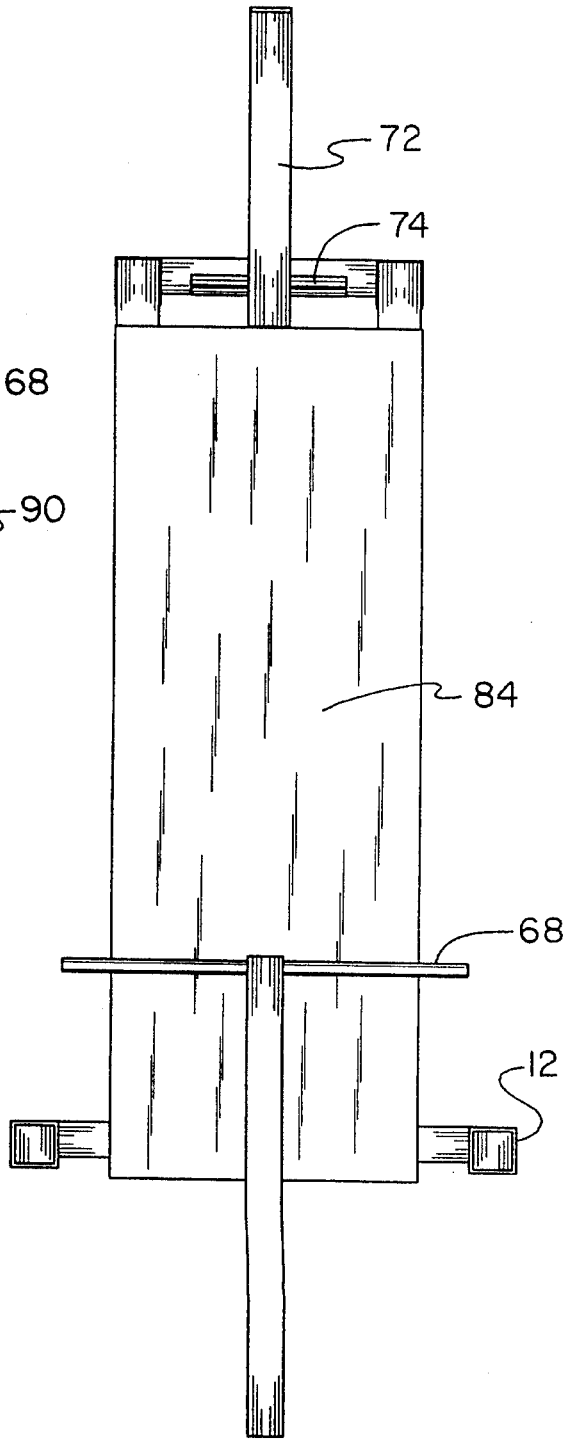
FIG. 4 is a plan view of the preferred embodiment of the present invention.
Figure 5:
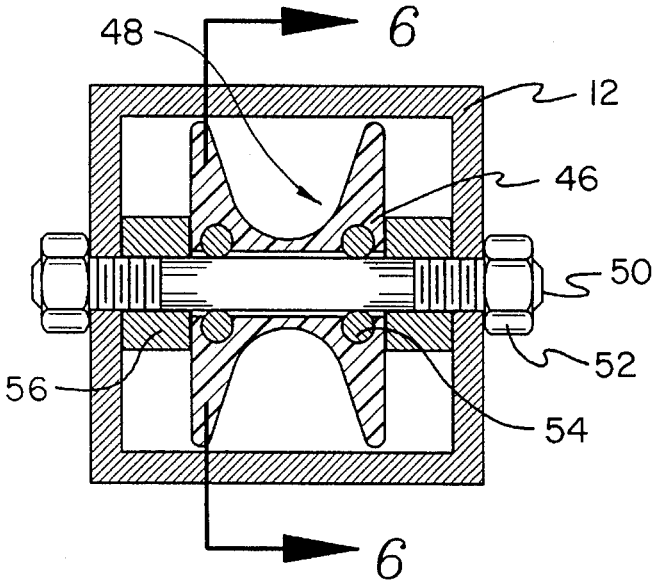
FIG. 5 is a front view of the pulley cage of the present invention.
Figure 6:
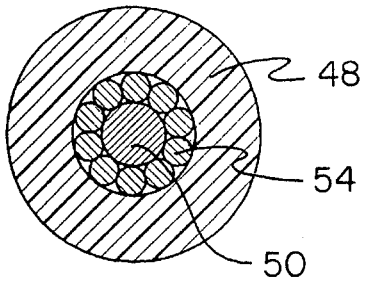
FIG. 6 is a cross-sectional view as taken along line 6—6 of FIG. 5.
Figure 7:
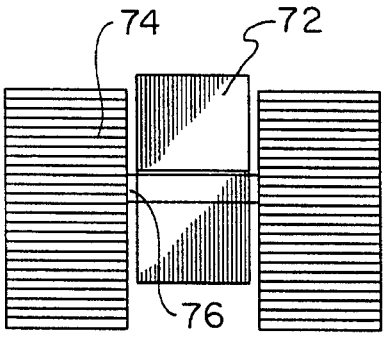
FIG. 7 is a front view of the foot pedal of the present invention.
Figure 8:
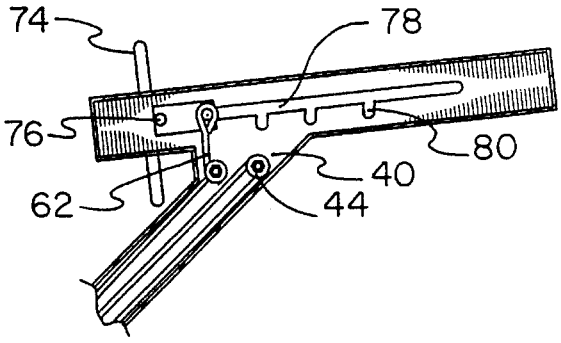
FIG. 8 is a side sectional view of the locking mechanism of the present invention.

With reference now to the drawings, and in particular, to FIG. 1–8 thereof, the preferred embodiment of the new and improved weightlifting machine with safety device embodying the principles and concepts of the present invention and generally designated by the reference number 10 will be described.

Specifically, it will be noted in the various Figures that the device relates to a new and improved weightlifting machine with safety device for protecting a user from injury when not being able to lift a weightbar. In its broadest context, the device consists of a hollow frame portion, a pulley system, a safety mechanism, and a weightlifting bench.

The device 10 contains a hollow frame portion 12 comprised of a first horizontal portion 14, a second horizontal portion 16, a vertical portion 18, and a diagonal portion 20. The first horizontal portion 14 has an upwardly open first end 22, a second end 24, and an intermediate extent 26 therebetween. The intermediate extent 26 has an opening 28 formed in a top surface thereof inwardly of the second end 24 thereof. The second horizontal portion 16 has a downwardly open first end 30 and an open second end 32. The vertical portion 18 has an open first end 34 and an open second end 36. The diagonal portion 20 has an open first end 38 and an open second end 40. The open first end 34 of the vertical portion 18 is secured to the upwardly open first end 22 of the first horizontal portion 14. The open second end 36 of the vertical portion 18 is secured to the downwardly open first end 30 of the second horizontal portion 16. The open first end 38 of the diagonal portion 20 is secured to the opening 28 in the intermediate extent 26 of the first horizontal portion 14.

The device 10 contains a pulley system 42 comprised of a plurality of pulley cages 44. The plurality of pulley cages 44 are securable within the hollow frame portion 12. The plurality of pulley cages 44 of the pulley system 42 further comprise a cable engaging portion 46 having two U-shaped portions 48. The cable engaging portion 46 is secured to the hollow frame portion 12 by a nut 50 and bolt 52 with two O-rings 54 and two washers 56. The pulley system 42 has a cable 58. The cable 58 has a first end 60, a second end 62, and an intermediate extent 64 therebetween. The first end 60 extends outwardly of the downwardly open second end 32 of the second horizontal portion 16. The first end 60 has a securement means 66 adapted to be secured to a weightbar 68. The second end 62 of the cable 58 extends outwardly of the open second end 40 of the diagonal portion 20. The intermediate extent 64 extends through the plurality of pulley cages 44 within the hollow frame portion 12.

A safety mechanism 72 is secured to the open second end 40 of the diagonal portion 20. The safety mechanism 72 has a foot pedal 74 secured on opposing sides thereof. The foot pedals 74 are pivotally secured to a securement bar 76 extending within the safety mechanism 72 and slides along a groove 78 therein. The securement bar 76 is secured to the second end 62 of the cable 58 of the pulley system 42. The safety mechanism 72 has a plurality of locking notches 80 therein extending downwardly from the groove 78 to engage the securement bar 76. When the weightlifter is unable to finish a final repetition, he/she can simply press on the foot pedals 74 to slide the securement bar 76 along the groove 78 to engage one of the plurality of locking notches 80 to safely support the weightbar that hangs from the cable 58. This allows the user to remove themselves from danger and reposition the weightbar on the weightlifting bench.

The device 10 contains a weightlifting bench 84 having forward 86 and rearward 88 ends for supporting a weightlifter thereon in a generally supine position along its longitudinal length and has upright weight supports 90 for supporting weights placed thereon located adjacent to the forward ends 86. The rearward ends 88 are adjacent to the foot pedals 74 of the safety mechanism 72 for engagement thereof by the weightlifter. The weightlifting bench 84 can be secured to the hollow frame portion 12 or can be a separate piece of equipment.

The present invention is a weightlifting machine with a safety device 10 that protects the user from injury, by allowing the weights to be raised with a foot pedal 74.

The device 10 consists of a hollo metal frame portion 12 with a base approximately five and a half feet long with a height of approximately five to six feet, in addition to an overhead extension for suspending weights. It also contains a padded weightlifting bench 84, a pulley system 42 with stranded steel cable 58, bench mat, and a foot pedal device 74. Plastic end caps provide access to the pulley system 42 and cable 58 for maintenance purposes.

The user attaches the cable 58 suspended from the frame's 12 overhang to the bar holding the weights. Then the lifter can do bench presses. When the user is too tired to lift the weights, he or she can push the foot pedal 74 with both feet which causes the pulley system 42 to lift the bar off of the chest of the user. The cable 58 locks into place, allowing the lifter to get off the bench.

This device 10 has an important safety feature for any lifter who has reached the point of exhaustion and cannot lift anymore. In gyms, "spotters" assist lifters by removing the weights when the lifter has "maxed out" and cannot do any more. For anyone who works out at home or alone, the foot pedal 74 ensures that the lifter can max out without the possibility of injury. The device 10 is easy to assemble, requires no electricity, and can be set up wherever there is sufficient space. It can be used safely at home or in gyms without the need for a spotter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A weightlifting machine with safety device for protecting a user from injury when not being able to lift a weightbar comprising, in combination:

a hollow frame portion comprising a first horizontal portion, a second horizontal portion, a vertical portion, and a diagonal portion, the first horizontal portion having an upwardly open first end, a second end, and an intermediate extent therebetween, the intermediate extent having an opening formed in a top surface thereof inwardly of the second end thereof, the second horizontal portion having a downwardly open first end and an open second end, the vertical portion having an open first end and an open second end, the diagonal portion having an open first end and an open second end, the open first end of the vertical portion secured to the upwardly open first end of the first horizontal portion, the open second end of the vertical portion secured to the downwardly open first end of the second horizontal portion, the open first end of the diagonal portion secured to the opening in the intermediate extent of the first horizontal portion;

a pulley system comprising of a plurality of pulley cages, the plurality of pulley cages securable within the hollow frame portion, the pulley system having a cable, the cable having a first end, a second end, and an intermediate extent therebetween, the first end extending outwardly of the downwardly open second end of the second horizontal portion, the first end having a securement means adapted to be secured to a weight bar, the second end of the cable extending outwardly of the open second end of the diagonal portion, the intermediate extent extending through the plurality of pulley cages within the hollow frame portion;

a safety mechanism secured to the open second end of the diagonal portion, the safety mechanism having a foot pedal secured on opposing sides thereof, the foot pedals pivotally secured to a securement bar extending within the safety mechanism and slidably coupled therein, the securement bar secured to the second end of the cable of the pulley system, the safety mechanism having a plurality of locking notches therein to engage the securement bar;

a weightlifting bench having forward and rearward ends for supporting a weightlifter thereon in a generally supine position along its longitudinal length and having upright weight supports for supporting weights placed thereon located adjacent to the forward ends, the rearward end being adjacent to the foot pedals of the safety mechanism for engagement thereof by the weightlifter.

2. A weightlifting machine with safety device for protecting a user from injury when not being able to lift a weightbar comprising, in combination:

a hollow frame portion;

a pulley system comprising a plurality of pulley cages and a cable securable within the hollow frame portion, the cable having a first end for engaging a weightbar;

a safety mechanism secured to the hollow frame portion, the safety mechanism having a foot pedal secured on opposing sides thereof, the foot pedals pivotally secured to a securement bar extending within the safety mechanism and slidably coupled therein, the securement bar secured to a second end of the cable of the pulley system, the safety mechanism having a plurality of locking notches therein to engage the securement bar.

3. The safety device as described in claim 2 and further including wherein the hollow frame portion comprising a first horizontal portion, a second horizontal portion, a vertical portion, and a diagonal portion, the first horizontal portion having an upwardly open first end, a second end, and an intermediate extent therebetween, the intermediate extent having an opening formed in a top surface thereof inwardly of the second end thereof, the second horizontal portion having a downwardly open first end and an open second end, the vertical portion having an open first end and an open second end, the diagonal portion having an open first end and an open second end, the open first end of the vertical portion secured to the upwardly open first end of the first horizontal portion, the open second end of the vertical portion secured to the downwardly open first end of the second horizontal portion, the open first end of the diagonal portion secured to the opening in the intermediate extent of the first horizontal portion.

4. The safety device as described in claim 3 and further including a weightlifting bench having forward and rearward ends for supporting a weightlifter thereon in a generally supine position along its longitudinal length and having upright weight supports for supporting weights placed thereon located adjacent to the forward ends, the rearward ends being adjacent to the foot pedals of the safety mechanism for engagement thereof by the weightlifter.

5. The safety device as described in claim 1 and further including wherein the plurality of pulley cages of the pulley system further comprising a cable engaging portion having two U-shaped portions, the cable engaging portion secured to the hollow frame portion by a nut and bolt with two O-rings and two washers.

* * * * *